US011774064B2

(12) United States Patent
Kuno et al.

(10) Patent No.: US 11,774,064 B2
(45) Date of Patent: Oct. 3, 2023

(54) LIGHTING DEVICE PROVIDED WITH LIGHTING EQUIPMENT LENS

(71) Applicant: AMBIENTEC CORPORATION, Yokohama (JP)

(72) Inventors: Yoshinori Kuno, Yokohama (JP); Yasushi Eguchi, Yokohama (JP)

(73) Assignee: AMBIENTEC CORPORATION, Yokohama (JP)

( * ) Notice: Subject to any disclaimer, the term of this patent is extended or adjusted under 35 U.S.C. 154(b) by 0 days.

(21) Appl. No.: 18/002,206

(22) PCT Filed: Feb. 18, 2022

(86) PCT No.: PCT/JP2022/006654

§ 371 (c)(1),
(2) Date: Dec. 16, 2022

(87) PCT Pub. No.: WO2022/270004

PCT Pub. Date: Dec. 29, 2022

(65) Prior Publication Data

US 2023/0184406 A1 Jun. 15, 2023

(30) Foreign Application Priority Data

Jun. 23, 2021 (JP) ..... 2021-104025

(51) Int. Cl.
*F21V 5/06* (2006.01)
*F21S 10/04* (2006.01)
(Continued)

(52) U.S. Cl.
CPC ..... *F21V 5/06* (2013.01); *F21S 10/04* (2013.01); *F21V 17/06* (2013.01); *F21V 31/005* (2013.01); *F21Y 2115/10* (2016.08)

(58) Field of Classification Search
CPC ..... F21V 5/06; F21V 17/06; F21V 31/005; F21S 10/04; F21Y 2115/10
See application file for complete search history.

(56) References Cited

U.S. PATENT DOCUMENTS 9,541,247 B2 * 1/2017 Patton ..... F21S 6/001
9,915,402 B2 * 3/2018 Dong ..... F21S 10/046
(Continued)

FOREIGN PATENT DOCUMENTS

JP 2011142060 A 7/2011
JP 5547697 B2 7/2014
(Continued)

*Primary Examiner* — Tsion Tumebo
(74) *Attorney, Agent, or Firm* — CALFEE HALTER & GRISWOLD LLP

(57) ABSTRACT

A lighting device including:
a lighting equipment lens unit; and
a stand member on which the lighting equipment lens unit is placed,
wherein the lighting equipment lens unit includes a lighting equipment lens in which a protruding portion capable of point-supporting the entire lighting equipment lens unit is formed,
a center of gravity of the lighting equipment lens unit is located substantially coaxially with the protruding portion and below the protruding portion,
the stand member includes:
a housing having an opening; and
a light transmitting placement portion that is placed in the housing and allows placement of the protruding portion,
the stand member allows irradiation of light toward the opening through the light transmitting placement portion, and
(Continued)

a surface of the light transmitting placement portion on which the protruding portion is placed is formed into a concave shape.

7 Claims, 8 Drawing Sheets

(51) Int. Cl.
*F21V 17/06* (2006.01)
*F21V 31/00* (2006.01)
*F21Y 115/10* (2016.01)

(56) References Cited

U.S. PATENT DOCUMENTS 10,323,810 B2 * 6/2019 Boldsen ..... F21S 10/046
10,352,538 B2 * 7/2019 Pan ..... F21V 21/14
11,092,302 B2 * 8/2021 Wu ..... F21S 6/001
2006/0034100 A1 * 2/2006 Schnuckle ..... F21V 13/14 362/362
2007/0242259 A1 * 10/2007 Kawakami ..... F21S 10/04 356/25
2010/0079999 A1 4/2010 Schnuckle
2011/0170299 A1 7/2011 Takase et al.
2013/0033874 A1 2/2013 Homma
2014/0211499 A1 * 7/2014 Fong ..... H05B 45/00 362/558
2014/0241004 A1 * 8/2014 Chen ..... F21S 10/04 362/569
2014/0362592 A1 * 12/2014 Lee ..... F21S 6/001 362/386
2018/0340678 A1 11/2018 Pan et al.
2020/0217469 A1 * 7/2020 Fan ..... F21S 10/046
2020/0412281 A1 * 12/2020 Li ..... H02N 15/00
2021/0062988 A1 * 3/2021 Ho ..... F21S 6/001

FOREIGN PATENT DOCUMENTS

JP 3192784 U 9/2014
JP 5897746 B 3/2016
KR 2020110008600 U 9/2011

* cited by examiner (a)

LIGHTING DEVICE PROVIDED WITH LIGHTING EQUIPMENT LENS

CROSS-REFERENCE TO RELATED APPLICATIONS

This application is a 371 of PCT Application No. PCT/JP2022/006654, filed Feb. 18, 2022, which claims priority to Japanese Application No. 2021-104025, filed on Jun. 23, 2021, the contents of which are hereby incorporated by reference as if recited in their entirety.

TECHNICAL FIELD

The present invention relates to a lighting device. Particularly, the present invention relates to a lighting device provided with a lighting equipment lens.

BACKGROUND ART

In recent years, various lighting devices having a light emitting portion that imitates the shape of flame have been developed.

As a conventional technology, for example, it is known to use a magnet in order to generate an effect of swinging flame (Patent Literature 1).

In addition, Patent Literature 2 discloses a device with two arms provided on a flame decorative piece and a weight provided at an end thereof.

As described in Patent Literature 3, it has been conventionally known that it is difficult to use an LED light as an alternative to an incandescent lamp since the LED light has strong directivity.

Patent Literature 3 discloses using a teardrop-shaped transparent body formed of a light transmissive material to totally reflect an LED light which has entered the teardrop-shaped transparent body and form an image, thereby creating a virtual light emitting portion.

CITATION LIST

Patent Literature

Patent Literature 1: JP 5897746 B2
Patent Literature 2: Japanese Utility Model Registration No. 3192784
Patent Literature 3: JP 5547697 B2

SUMMARY OF INVENTION

Technical Problem

As disclosed in Patent Literature 3, it has been considered that it is necessary to cause an LED light to enter a transparent body since the LED light has strong directivity.

In addition, glare (dazzle) emitted from the inside of a lens when the LED light enters the transparent body has caused a problem.

Here, as a result of intensive research by the present inventors, it has been found that an LED light travels along an outer surface of a lighting equipment lens by using the lighting equipment lens having a protruding portion capable of point support and emitting a refracted LED light from a lower portion toward the protruding portion.

Furthermore, it has been found that as the LED light travels along the outer surface of the lighting equipment lens, the entire lighting equipment lens emits light, and a virtual light emitting portion can be created.

That is, an object of the present invention is to provide a novel lighting device including a virtual light emitting portion and a lighting equipment lens that swings like a balancing toy.

In addition, in a preferred mode of the present invention, an object is to provide a lighting device that alleviates glare (dazzle) from the inside of a lighting equipment lens and causes less irritation even when the lighting equipment lens is viewed directly nearby.

Furthermore, in a preferred mode of the present invention, an object is to provide a lighting device that exhibits a soft lighting manner.

Solution to Problem

The present invention that solves the problems described above is a lighting device including:

a lighting equipment lens unit; and a stand member on which the lighting equipment lens unit is placed, wherein the lighting equipment lens unit includes a lighting equipment lens in which a protruding portion capable of point-supporting the entire lighting equipment lens unit is formed, a center of gravity of the lighting equipment lens unit is located substantially coaxially with the protruding portion and below the protruding portion, the stand member includes:

a housing having an opening; and a light transmitting placement portion that is placed in the housing and allows placement of the protruding portion, the stand member allows irradiation of light toward the opening through the light transmitting placement portion, and a surface of the light transmitting placement portion on which the protruding portion is placed is formed into a concave shape.

According to the present invention, it is possible to provide a novel lighting device in which the lighting equipment lens itself serves as a virtual light emitting portion and the lighting equipment lens itself swings like a balancing toy (see FIG. 7).

Specifically, since the surface of the light transmitting placement portion on which the protruding portion is placed is formed into a concave shape, a light beam which has struck a slope of the light transmitting placement portion is refracted, and thus, an LED light hardly enters the lighting equipment lens.

In addition, since the lighting equipment lens includes the protruding portion, the LED light hardly enters the lighting equipment lens.

That is, with the mode described above, the LED light from the light transmitting placement portion travels along the protruding portion and along an outer surface of the lighting equipment lens. Then, as the LED light travels along the outer surface of the lighting equipment lens, the entire lighting equipment lens serves as the virtual light emitting portion.

In addition, the configuration in which the LED light hardly enters the lighting equipment lens can alleviate glare (dazzle) from the inside of the lighting equipment lens.

Since the LED light hardly enters the lighting equipment lens in such a configuration, it is possible to provide a lighting device that causes less irritation even when the lighting equipment lens is viewed directly nearby.

Furthermore, according to the present invention, it is possible to provide a lighting device that exhibits a soft lighting manner.

In a preferred mode of the present invention, the surface of the light transmitting placement portion on which the protruding portion is placed is formed into a conically recessed shape, and an inclination angle of the surface is 5° or more and 30° or less.

Since the surface of the light transmitting placement portion on which the protruding portion is placed is formed into a conically recessed shape (a mortar shape), the protruding portion of the lighting equipment lens can be placed at a desired position (the central portion of the light transmitting placement portion). Furthermore, the position of a fulcrum (a placement position of the protruding portion) hardly shifts even when a lighting equipment lens 21 moves.

Additionally, since the surface on which the protruding portion is placed is formed into a conically recessed shape (a mortar shape), a light beam which has struck the slope of the light transmitting placement portion is refracted, and thus, the LED light hardly enters the lighting equipment lens. The configuration in which the LED light hardly enters the lighting equipment lens can alleviate glare (dazzle) from the inside of the lighting equipment lens.

In a preferred mode of the present invention, the stand member includes LED light irradiation means that is placed in the housing and allows irradiation of light toward the opening through the light transmitting placement portion.

In a preferred mode of the present invention, the lighting equipment lens unit includes:

a weight portion placed such that a center of gravity of the lighting equipment lens unit is located substantially coaxially with the protruding portion and below the protruding portion; and an arm portion connecting the lighting equipment lens and the weight portion, and an overall shape of the arm portion is a ring shape.

By forming the overall shape of the arm portion connecting the lighting equipment lens and the weight portion into a ring shape, the lighting equipment lens unit swinging like a balancing toy is less likely to interfere with another component.

In addition, by forming the overall shape of the arm portion into a ring shape, it is possible to provide a lighting equipment lens unit with an aesthetically better appearance.

In a preferred mode of the present invention, the lighting device is a stationary lighting device, the stand member includes:

a base portion that allows the stand member to stand on its own when placed on the ground; and a connecting portion connecting the base portion and the housing including the light transmitting placement portion, and the connecting portion is curved so as not to interfere with the arm portion.

By forming the shape of the arm portion connecting the lighting equipment lens and the weight portion into a ring shape and curving the connecting portion, the lighting equipment lens unit swinging like a balancing toy is less likely to interfere with the connecting portion.

In a preferred mode of the present invention, the weight portion is located substantially coaxially with the protruding portion and below the protruding portion, the weight portion includes a magnetic force generation mechanism, and the base portion includes a magnetic force generation mechanism substantially coaxial with the protruding portion.

With the mode described above, the magnetic force generation mechanism included in the weight portion is affected by the magnetic force generation mechanism included in the base portion.

Then, since the weight portion receives magnetic force, the lighting equipment lens unit swings like a balancing toy more reliably for a longer time.

More specifically, the movement of the lighting equipment lens unit that starts to swing like a balancing toy due to ambient wind or the like can be assisted by the magnetic force generation mechanism. Then, with the movement assistance by the magnetic force, it is possible to provide a lighting device that exhibits natural fluctuation with less regularity, which is closer to real flames of candles and the like.

In a preferred mode of the present invention, a waterproof mechanism is provided so that the inside of the housing and the light transmitting placement portion are liquid-tight.

With the mode described above, it is possible to provide a lighting device that can be used even during rainfall, in which a candle cannot be used.

Advantageous Effects of Invention

According to the present invention, it is possible to provide a novel lighting device in which a lighting equipment lens itself serves as a virtual light emitting portion and the lighting equipment lens itself swings like a balancing toy.

BRIEF DESCRIPTION OF DRAWINGS

FIG. 4(*c*) is a schematic view illustrating a magnet body provided inside the weight portion 23 of the present embodiment.

FIG. 5(*b*) is a front view of the lighting equipment lens 21. FIG. 5(*c*) is a plan view of the lighting equipment lens 21.

Note that lines appearing on the surface of the lighting equipment lens 21 are shadow lines for showing a surface shape.

Figure 8:
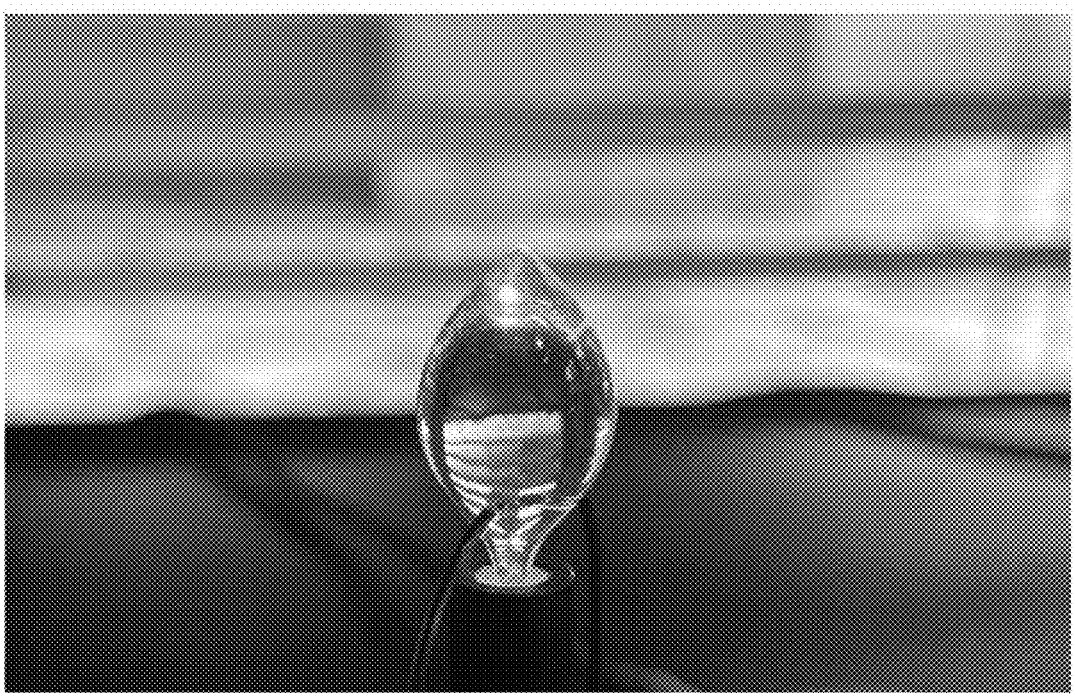

FIG. 8 is a diagram illustrating a state in which an LED light from the light transmitting placement portion 32 travels along the protruding portion 211 and along an outer surface of the lighting equipment lens 21 and the entire lighting equipment lens 21 serves as a virtual light emitting portion.

DESCRIPTION OF EMBODIMENTS

Hereinafter, a lighting device 1 of the present embodiment will be described, but it goes without saying that the technical scope of the present invention is not limited to the embodiment.

The lighting device 1 of the lighting device 1 of the present embodiment includes a lighting equipment lens unit 2 and a stand member 3.

Here, in the lighting device 1 of the lighting device 1 of the present embodiment, the lighting equipment lens unit 2 is placed on the stand member 3.

In the lighting device 1 of the present embodiment, the lighting equipment lens unit 2 has a center of gravity located substantially coaxially with a protruding portion 211 and below the protruding portion 211.

In addition, the lighting equipment lens unit 2 includes the protruding portion 211 capable of point-supporting the entire lighting equipment lens unit 2.

Furthermore, in the lighting device 1 of the present embodiment, the stand member 3 includes:

- a housing 31 having an opening 311;
- a light transmitting placement portion 32 that is placed in the housing 31 and allows placement of the protruding portion 211; and
- LED light irradiation means 33 that is placed in the housing 31 and allows irradiation of light toward the opening 311 through the light transmitting placement portion 32.

A surface of the light transmitting placement portion 32 on which the protruding portion 211 is placed is formed into a concave shape.

With the lighting device 1 of the lighting device 1 of the present embodiment, it is possible to provide a novel lighting device in which a lighting equipment lens itself serves as a virtual light emitting portion and the lighting equipment lens itself swings like a balancing toy.

Specifically, since the surface of the light transmitting placement portion 32 on which the protruding portion 211 is placed is formed into a concave shape, a light beam which has struck a slope of the light transmitting placement portion 32 is refracted, and thus, the LED light hardly enters the lighting equipment lens 21.

In addition, since the lighting equipment lens 21 includes the protruding portion 211, the LED light hardly enters the lighting equipment lens 21.

That is, with the mode described above, the LED light from the light transmitting placement portion 32 travels along the protruding portion 211 and along an outer surface of the lighting equipment lens 21. Then, as the LED light travels along the outer surface of the lighting equipment lens 21, the entire lighting equipment lens 21 serves as a virtual light emitting portion.

In addition, the configuration in which the LED light hardly enters the lighting equipment lens 21 can alleviate glare (dazzle) from the inside of the lighting equipment lens.

Since the LED light hardly enters the lighting equipment lens 21 in such a configuration, it is possible to provide the lighting device 1 with less irritation even when the lighting equipment lens 21 is viewed directly nearby.

Furthermore, according to the present invention, it is possible to provide the lighting device 1 that exhibits a soft lighting manner.

Since the lighting equipment lens unit 2 swings like a balancing toy, it is possible to make the appearance of the light emission from the lighting equipment lens 21 more similar to fire.

Figure 7:
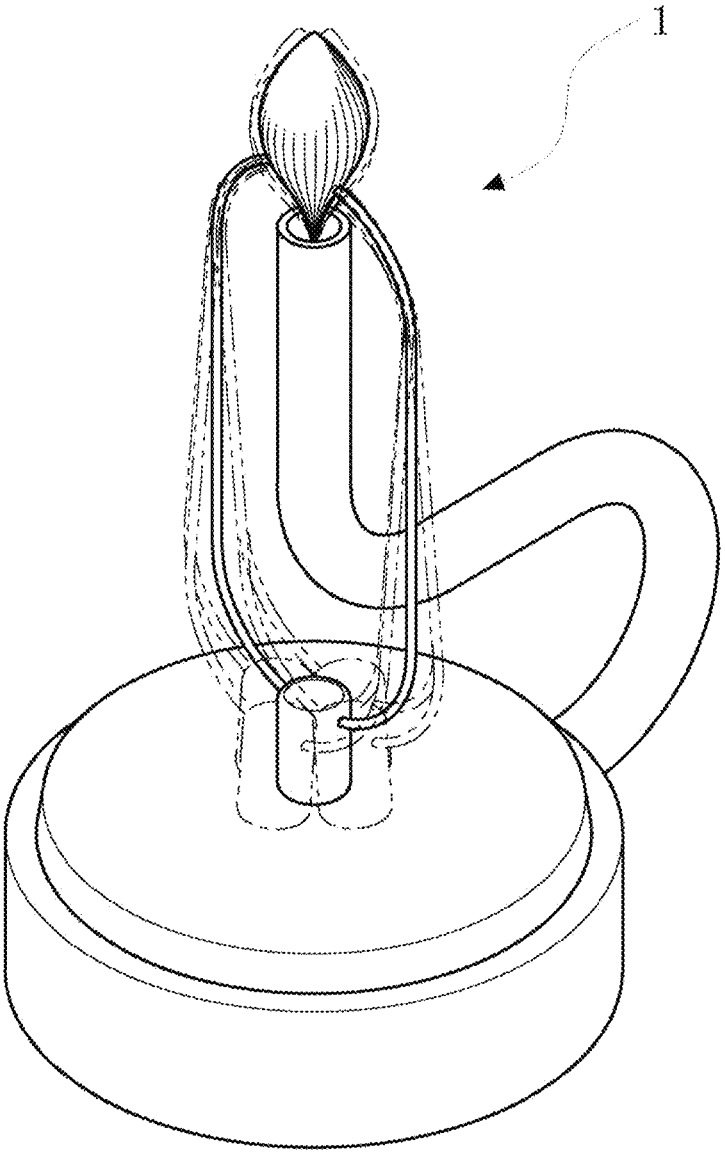
FIG. 7 is a schematic view illustrating a state in which the lighting equipment lens 21 swings on the light transmitting placement portion 32 with the protruding portion 211 as a fulcrum in the lighting device 1 of the present embodiment.

In addition, since the lighting equipment lens 21 itself swings, the LED light itself that travels along the lighting equipment lens 21 also swings exquisitely, thereby making the appearance of the light emission from the lighting equipment lens 21 more similar to fire (see FIGS. 7 and 8).

Hereinafter, a more preferred mode of the lighting device 1 of the lighting device 1 of the present embodiment will be described in detail with reference to FIGS. 1 to 8.

(1) Lighting Equipment Lens Unit 2

Figure 3:
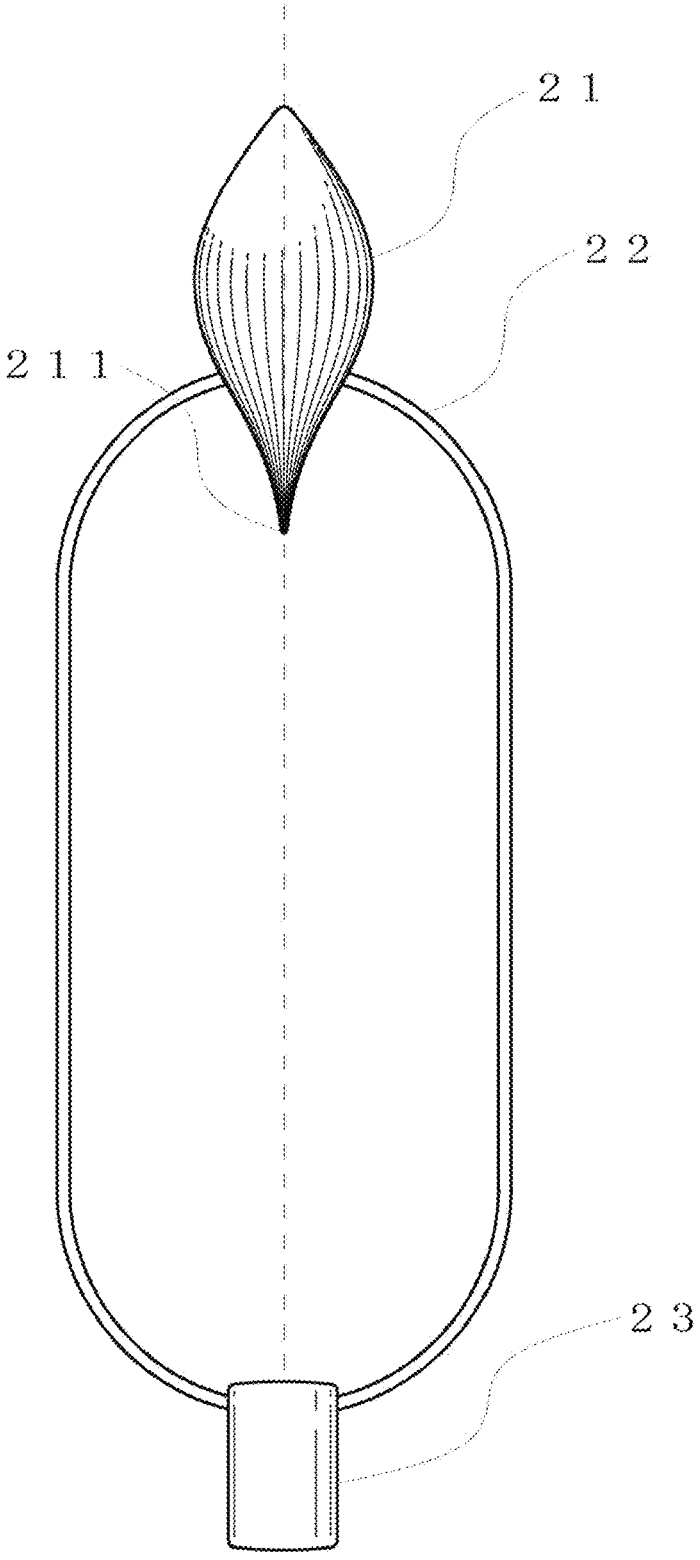
FIG. 3(*a*) illustrates a lighting equipment lens unit according to the present embodiment. Note that lines appearing on the surface of the lighting equipment lens 21 are shadow lines for showing a surface shape.

In the present specification, the lighting equipment lens unit 2 refers to a unit member consisting of a combination of the lighting equipment lens 21 and components which allow the lighting equipment lens 21 to be placed (see FIG. 3).

Figure 4:
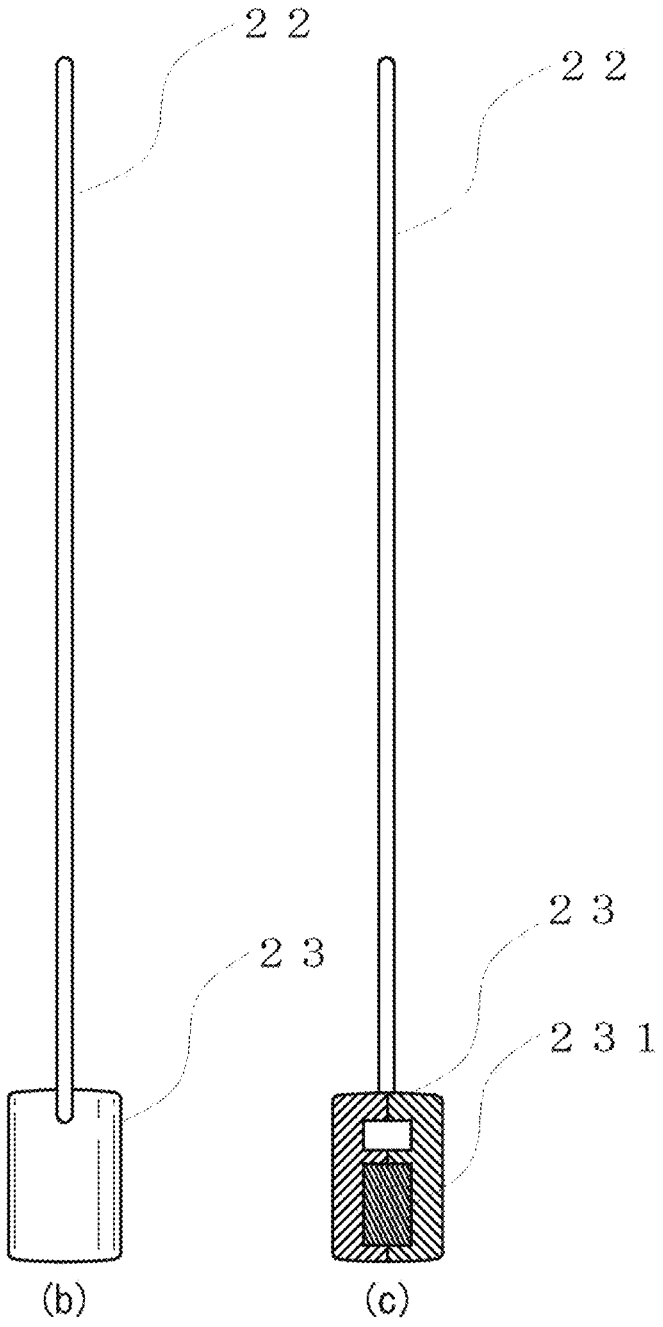
FIG. 4(*b*) is a schematic side view illustrating an arm portion 22 and a weight portion 23 of the present embodiment.

As illustrated in FIGS. 3 and 4, the lighting equipment lens unit 2 includes a lighting equipment lens 21, a weight portion 23, and an arm portion 22 connecting the lighting equipment lens 21 and the weight portion 23.

Hereinafter, each configuration of the lighting equipment lens unit 2 in the lighting device 1 of the present embodiment will be described in detail.

(i) Lighting Equipment Lens 21

Figure 5:
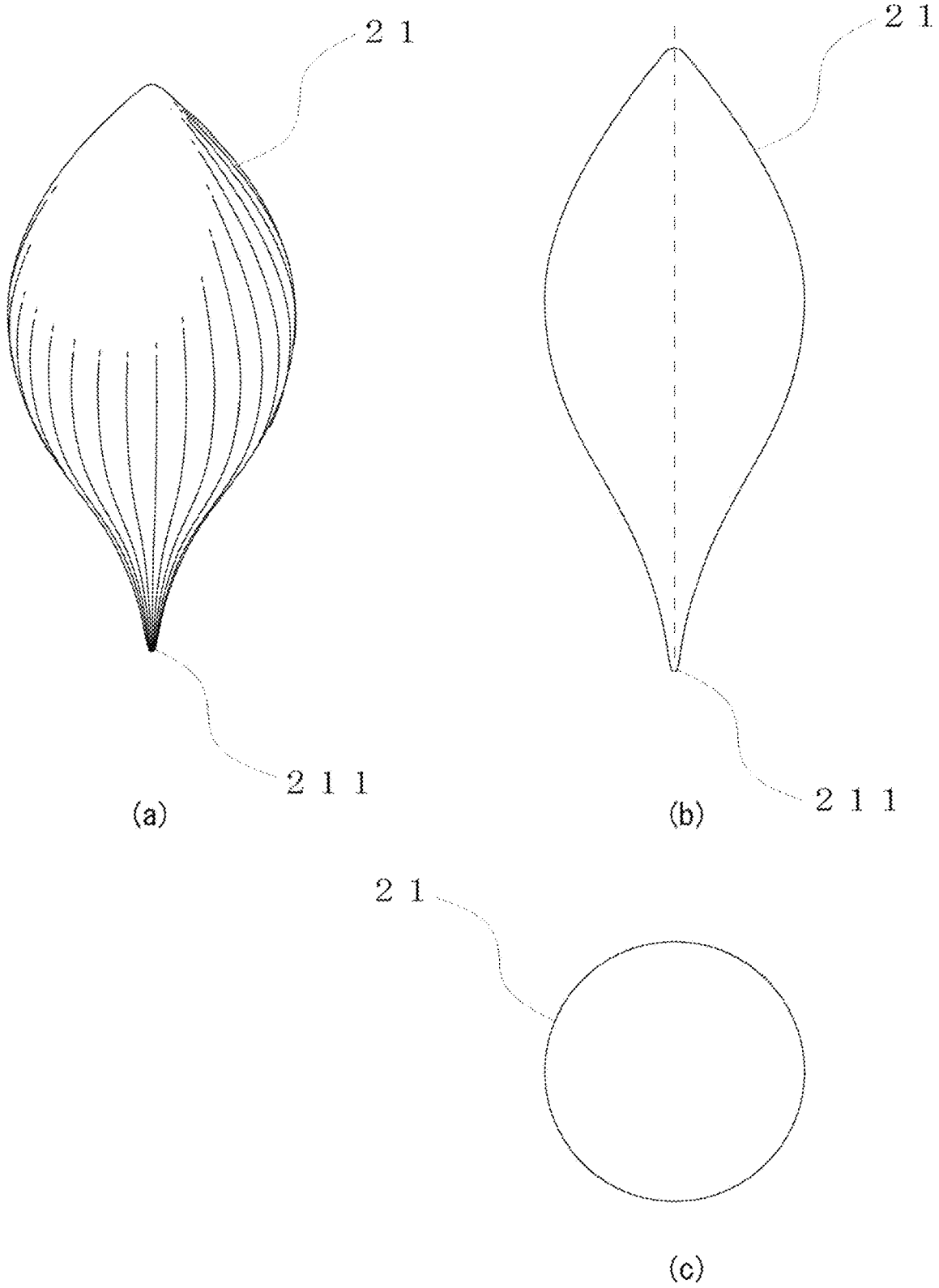
FIG. 5(*a*) is a diagram illustrating a three-dimensional shape of the lighting equipment lens 21. Note that lines appearing on the surface of the lighting equipment lens 21 are shadow lines for showing a surface shape.
Figure 6:
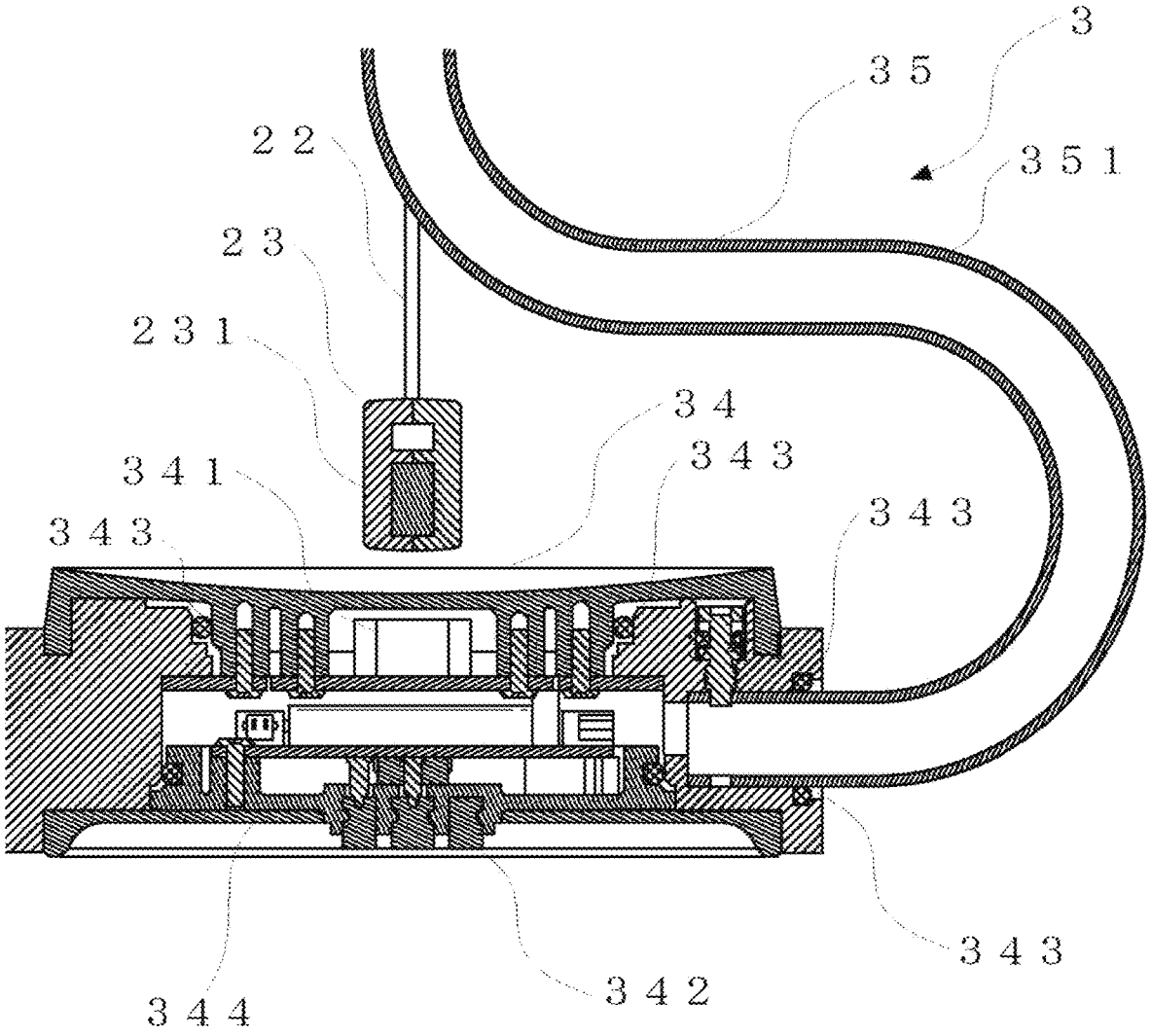
FIG. 6 is a schematic internal view of a stand member 3 and the weight portion 23 of the present embodiment.

In the present specification, "lighting equipment lens 21" refers to a lens used in lighting equipment for the purpose of creating a virtual light emitting portion at a position away from an actual light source (see FIG. 5).

The lighting equipment lens 21 of the present embodiment is made of a material having translucency.

Here, "having translucency" in the present specification means a property capable of transmitting light. In addition, "material having translucency" in the present specification encompasses both a translucent material and a transparent material.

Here, the lighting equipment lens 21 is preferably a transparent body.

Since the lighting equipment lens 21 is a transparent body, it is possible to receive light from the sun or another light source. Then, by combining the LED light from the light transmitting placement portion 32 and sunlight or light from another light source, it is possible to form a light emitting portion unique to an environment in which the lighting device 1 of the present invention is placed.

The material for the lighting equipment lens 21 of the present embodiment is an acrylic resin (see FIG. 8).

Here, in the present invention, the material for the lighting equipment lens 21 is not particularly limited.

As the material for the lighting equipment lens 21, for example, a synthetic resin (organic glass) or glass can be preferably used in addition to the material described above.

In addition, an overall shape of the lighting equipment lens 21 of the present embodiment is a tapered shape (corresponding to the protruding portion 211 in the present invention) at the lower end in the major axis direction of a prolate spheroid and a tapered shape at the upper end in the major axis direction of the prolate spheroid when the lighting equipment lens 21 is placed such that the major axis direction of the prolate spheroid is oriented at the top and bottom (see FIG. 5).

Here, the protruding portion 211 of the present embodiment is formed into a pointed shape whose diameter gradually decreases downward.

Since the protruding portion 211 is formed into a pointed shape whose diameter gradually decreases downward, it is possible to balance the lighting equipment lens unit 2 more efficiently.

In addition, the protruding portion 211 of the present embodiment is formed such that light from the LED light irradiation means 33 enters the protruding portion 211 at an acuter angle than the total reflection angle.

With the mode described above, it is possible to alleviate glare (dazzle) from the inside of the lighting equipment lens.

Here, regarding the degree of acuteness of the protruding portion 211, the angle of the central angle is preferably 30° or more, more preferably 45° or more, more preferably 60° or more, more preferably 90° or more, and still more preferably 100° or more when the protruding portion 211 is seen in a developed view.

In addition, regarding the degree of acuteness of the protruding portion 211, the angle of the central angle can be preferably 180° or less, more preferably 150° or less, and more preferably 130° or less as a target when the protruding portion 211 is seen in the developed view.

Here, for the central angle of the protruding portion 211, it is possible to use a value obtained by approximating the developed view of the protruding portion 211 to a developed view of a cone.

In addition, the upper end side of the lighting equipment lens 21 of the present embodiment is formed into an obtuse shape whose diameter gradually decreases upward in comparison with the protruding portion 211.

Here, regarding the degree of obtuseness of the upper end side of the lighting equipment lens 21, the angle of the central angle is preferably 90° or more, more preferably 150° or more, more preferably 160° or more, and more preferably 170° or more when the upper end portion of the lighting equipment lens 21 is seen in a developed view.

In addition, regarding the degree of obtuseness of the upper end side of the lighting equipment lens 21, the angle of the central angle can be preferably 270° or less, more preferably 250° or less, and more preferably 200° or less as a target when the upper end side of the lighting equipment lens 21 is seen in the developed view.

Here, for the central angle of the upper end side of the lighting equipment lens 21, it is possible to use a value obtained by approximating the developed view of the upper end side of the lighting equipment lens 21 to a developed view of a cone.

Since the lighting equipment lens 21 includes the protruding portion 211, it is possible to point-support the entire lighting equipment lens unit 2 by the lighting equipment lens 21.

Since the entire lighting equipment lens unit 2 can be point-supported by the lighting equipment lens 21, the LED light from the light transmitting placement portion 32 travels along the protruding portion 211 and along the outer surface of the lighting equipment lens 21. Then, as the LED light travels along the outer surface of the lighting equipment lens 21, the entire lighting equipment lens 21 serves as a virtual light emitting portion.

However, in the present invention, the shape of the protruding portion 211 may be a conical shape whose diameter gradually decreases downward.

Since the protruding portion 211 has a shape whose diameter gradually decreases downward, the LED light travels along the outer surface of the lighting equipment lens 21 more reliably. Then, as the LED light travels along the outer surface of the lighting equipment lens 21, the entire lighting equipment lens 21 serves as a virtual light emitting portion.

In the present invention, the shape of the protruding portion 211 is not particularly limited as long as the entire lighting equipment lens unit 2 can be point-supported by the protruding portion 211 of the lighting equipment lens 21.

In addition, the overall shape of the lighting equipment lens 21 is not particularly limited as long as the lighting equipment lens 21 includes the protruding portion 211 and has a shape which allows an LED light refracted by the light transmitting placement portion 32 described later to travel along the outer surface.

The overall shape of the lighting equipment lens 21 may be, for example, a conical shape, a pyramidal shape, or a shape in which the lower end in the major axis direction of a spherical shape is tapered.

Here, in the present invention, the overall shape of the lighting equipment lens 21 is preferably a rotationally symmetrical shape about the substantially central axis of the protruding portion 211.

In addition, the entire size of the lighting equipment lens 21 is not particularly limited as long as the lighting equipment lens 21 can be placed on the light transmitting placement portion 32 described later and the effect of the present invention is not impaired.

(ii) Weight Portion 23

In the present specification, the weight portion 23 is a member that adjusts the center of gravity of the lighting equipment lens unit 2 such that it is located substantially coaxially with the protruding portion 211 and below the protruding portion 211.

The weight portion 23 allows the center of gravity of the lighting equipment lens unit 2 to be located substantially coaxially with the protruding portion 211 and below the protruding portion 211.

Since the center of gravity of the lighting equipment lens unit 2 is located substantially coaxially with the protruding portion 211 and below the protruding portion 211, the lighting equipment lens 21 itself swings like a balancing toy with the protruding portion 211 as a fulcrum.

Then, since the lighting equipment lens unit 2 swings like a balancing toy, it is possible to make the appearance of the light emission from the lighting equipment lens 21 more similar to fire.

In addition, since the lighting equipment lens 21 itself swings, the LED light itself that travels along the lighting equipment lens 21 also swings exquisitely, thereby making the appearance of the light emission from the lighting equipment lens 21 more similar to fire.

The weight portion 23 of the present embodiment is located substantially coaxially with the protruding portion 211 and below the protruding portion 211.

The weight portion 23 is provided with a weight magnetic force generation mechanism 231.

With the mode described above, the weight magnetic force generation mechanism 231 included in the weight portion 23 is affected by a base magnetic force generation mechanism 341 included in a base portion 34.

Then, since the weight portion 23 receives magnetic force, the lighting equipment lens unit 2 swings like a balancing toy more reliably for a longer time.

More specifically, the movement of the lighting equipment lens unit 2 that starts to swing like a balancing toy due to ambient wind or the like can be assisted by the magnetic force generation mechanism (the weight magnetic force generation mechanism 231 and the base magnetic force generation mechanism 341). Then, with the movement assistance by the magnetic force, it is possible to provide a lighting device that exhibits natural fluctuation with less regularity, which is closer to real flames of candles and the like.

The weight magnetic force generation mechanism 231 of the present embodiment is a neodymium magnet. By using the neodymium magnet, it is possible to design the overall shape of the weight portion 23 compactly.

Then, by making the overall shape of the weight portion 23 compact, the lighting equipment lens unit 2 is less likely to interfere with another component when the lighting equipment lens unit 2 swings like a balancing toy.

However, in the present invention, the weight magnetic force generation mechanism 231 may be any of a ferrite magnet, a neodymium magnet, a samarium-cobalt magnet, an alnico magnet, and an electromagnet.

In the present invention, the number, weight, and mechanism of the weight portion 23 are not particularly limited.

(iii) Arm Portion 22

In the present specification, the arm portion 22 is a member connecting the lighting equipment lens 21 and the weight portion 23 described above.

Here, in the present embodiment, the two arm portions 22 are provided so as to hang downward from the lighting equipment lens 21.

Furthermore, the arm portions 22 of the present embodiment are placed such that the overall shape of the arm portions 22 is symmetrical with the axis of the protruding portion 211 as a median line (see FIG. 3).

In addition, the overall shape of the arm portions 22 of the present embodiment is preferably line-symmetric with the axis of the protruding portion 211 as a median line.

With the mode described above, it is possible to provide the lighting device 1 with more sense of unity.

Here, the overall shape of the arm portions 22 is preferably a ring shape when viewed from the front.

By forming the overall shape of the arm portions 22 connecting the lighting equipment lens 21 and the weight portion 23 into a ring shape, the lighting equipment lens unit 2 swinging like a balancing toy is less likely to interfere with another component.

By forming the overall shape of the arm portions 22 into a ring shape, it is possible to provide the lighting equipment lens unit 2 with an aesthetically better appearance.

Furthermore, since the overall shape of the arm portions 22 is a line-symmetric ring shape with the axis of the protruding portion 211 as a median line, it is possible to place the weight portion 23 substantially coaxially with the protruding portion 211 and below the protruding portion 211.

However, in the present invention, the shape of the arm portion 22 does not necessarily have to be symmetrical as long as it is possible to balance the entire lighting equipment lens unit 2 with the protruding portion 211 as a fulcrum.

In the present invention, the shape, number, size, and material of the arm portion 22 are not particularly limited.

In the lighting device 1 of the present embodiment, the arm portion 22 and the weight portion 23 are configured as separate members.

However, in the present invention, the arm portion 22 and the weight portion 23 may be integrally formed.

Furthermore, the weight portion 23 may also serve as the arm portion 22.

In addition, the material, size, shape, and the like of the arm portion are not particularly limited.

(2) Stand Member 3

In the present specification, the stand member 3 is a member on which the lighting equipment lens unit 2 described above is placed.

The stand member 3 of the present embodiment includes:

the housing 31;

the light transmitting placement portion 32 placed in the housing 31; and the LED light irradiation means 33 placed in the housing 31.

(i) Housing 31

In the present specification, the housing 31 is a member for placing the light transmitting placement portion 32 and the LED light irradiation means 33 described later inside.

Furthermore, the housing 31 includes the opening 311 that allows the protruding portion 211 of the lighting equipment lens 21 placed to be irradiated with light through the light transmitting placement portion 32.

Here, the opening 311 of the present embodiment is directed upward.

However, in the present invention, the opening 311 may be directed to any direction as long as the lighting equipment lens unit 2 does not fall off in a state where the light transmitting placement portion 32 described later is placed in the housing.

In addition, a wall surface of the housing 31 of the present embodiment also serves as a shade portion 312 that shades unnecessary light out of the LED light emitted through the light transmitting placement portion 32.

With the mode including the shade portion 312, even when a user approaches the lighting device 1 and checks a light source portion, a light source of the LED light irradiation means 33 does not enter user's eyes.

Here, the ½ beam angle of the light from the LED light irradiation means 33, defined by the shade portion 312, is 30°.

The ½ beam angle of the light from the LED light irradiation means 33 refers to a value obtained by doubling an angle (a in FIG. 2) from a central portion (the central axis) at which the luminous intensity of the light is the maximum to a position at which the luminous intensity is ½ of the brightness at the central portion (the central axis).

The ½ beam angle of the light from the LED light irradiation means 33, defined by the shade portion 312, may be preferably 10° or more, more preferably 15° or more, and still more preferably 20° or more.

When the ½ beam angle of the light from the LED light irradiation means 33, defined by the shade portion 312, is equal to or larger than the lower limit, it is possible to brighten the entire lighting equipment lens 21 efficiently.

The ½ beam angle of the light from the LED light irradiation means 33, defined by the shade portion 312, is preferably 90° or less, more preferably 60° or less, and still more preferably 45° or less.

When the ½ beam angle of the light from the LED light irradiation means 33, defined by the shade portion 312, is equal to or less than the upper limit, it is possible to brighten the entire lighting equipment lens 21 efficiently.

With the mode described above, even when a user approaches the lighting device 1 and checks the light source portion, the light source of the LED light irradiation means 33 does not enter user's eyes.

Here, the housing 31 of the present embodiment has a cylindrical shape.

Since the housing 31 has a cylindrical shape, it is possible to brighten the entire lighting equipment lens 21 more reliably and efficiently.

Furthermore, since the housing 31 has a cylindrical shape, even when a user approaches the lighting device 1 and checks the light source portion, the light source of the LED light irradiation means 33 does not enter user's eyes.

The opening 311 of the housing 31 has a circular shape when viewed in plan view.

With the mode described above, it is possible to brighten the entire lighting equipment lens 21 more reliably and efficiently.

With the mode described above, even when a user approaches the lighting device 1 and checks the light source portion, the light source of the LED light irradiation means 33 does not enter user's eyes.

In addition, the opening 311 of the housing 31 when viewed in plan view is smaller than the area of the lighting equipment lens 21 described above in plan view (see FIGS. 2 and 5).

With the mode described above, it is possible to brighten the entire lighting equipment lens 21 more reliably and efficiently.

In addition, with the mode described above, even when a user approaches the lighting device 1 and checks the light source portion, the light source of the LED light irradiation means 33 does not enter user's eyes.

However, in the present invention, the shape and size of the housing 31 are not particularly limited as long as the light transmitting placement portion 32 and the LED light irradiation means 33 described later can be placed.

(ii) Light Transmitting Placement Portion 32

Here, the light transmitting placement portion 32 of the present embodiment is a member that is placed inside the housing 31 and allows placement of the protruding portion 211.

The light transmitting placement portion 32 of the present embodiment is made of a material having translucency.

The light transmitting placement portion 32 of the present embodiment also serves as a lens member.

Here, the light transmitting placement portion 32 is preferably a transparent body.

Since the light transmitting placement portion 32 is a transparent body, it is possible to provide the lighting device 1 with an aesthetically better appearance.

The material for the light transmitting placement portion 32 of the present embodiment is an acrylic resin.

Here, in the present invention, the material for the light transmitting placement portion 32 is not particularly limited.

As the material for the light transmitting placement portion 32, for example, a synthetic resin (organic glass) or glass can be preferably used in addition to the material described above.

In the lighting device 1 of the present embodiment, the surface of the light transmitting placement portion 32 on which the protruding portion 211 is placed is formed into a conically recessed shape (a mortar shape).

Since the surface of the light transmitting placement portion 32 on which the protruding portion 211 is placed is formed into a conically recessed shape (a mortar shape), the protruding portion 211 of the lighting equipment lens 21 can be placed at a desired position (the central portion of the light transmitting placement portion 32). Then, after the protruding portion 211 of the lighting equipment lens 21 is placed at the central portion of the light transmitting placement portion 32, the position of a fulcrum (a placement position of the protruding portion 211) hardly shifts even when the lighting equipment lens 21 moves.

Since the surface on which the protruding portion 211 is placed is formed into a conically recessed shape (a mortar shape), a light beam which has struck a slope of the light transmitting placement portion 32 is refracted, and thus, the LED light hardly enters the lighting equipment lens 21. Then, the configuration in which the LED light hardly enters the lighting equipment lens 21 can alleviate glare (dazzle) from the inside of the lighting equipment lens.

Since the LED light hardly enters the lighting equipment lens in such a configuration, it is possible to provide a lighting device with less irritation even when the lighting equipment lens is viewed directly nearby.

The inclination angle of the surface of the light transmitting placement portion 32, formed into a conically recessed shape (a mortar shape), is 15°.

In the present specification, the inclination angle refers to a degree of inclination with respect to a horizontal plane.

The inclination angle of the surface of the light transmitting placement portion 32, formed into a conically recessed shape (a mortar shape), may be preferably 5° or more, more preferably 7° or more, and still more preferably 10° or more.

When the inclination angle of the surface of the light transmitting placement portion 32, formed into a conically recessed shape (a mortar shape), is equal to or larger than the lower limit, the protruding portion 211 of the lighting equipment lens unit 2 can be placed at a desired position.

The inclination angle of the surface of the light transmitting placement portion 32, formed into a conically recessed shape (a mortar shape), is preferably 45° or less, more preferably 30° or less, still more preferably 20° or less, and particularly preferably 15° or less.

When the inclination angle of the surface of the light transmitting placement portion 32, formed into a conically recessed shape (a mortar shape), is equal to or larger than the upper limit, it is possible to brighten the entire lighting equipment lens 21 efficiently.

In addition, with the mode described above, even when a user approaches the lighting device 1 and checks the light source portion, the light source of the LED light irradiation means 33 does not enter user's eyes.

In addition, with the mode described above, the lighting equipment lens 21 itself serves as a virtual light emitting portion (see FIG. 8).

Specifically, the LED light from the light transmitting placement portion 32 travels along the protruding portion 211 and along the outer surface of the lighting equipment lens 21. Then, as the LED light travels along the outer surface of the lighting equipment lens 21, the entire lighting equipment lens 21 serves as a virtual light emitting portion (see FIG. 2).

Here, in the present invention, the surface of the light transmitting placement portion 32 on which the protruding portion 211 is placed may be formed into a concave shape.

In the present invention, the surface of the light transmitting placement portion 32 on which the protruding portion 211 is placed is preferably formed of a rotationally symmetrical surface about the substantially central axis of the light transmitting placement portion 32.

The light transmitting placement portion 32 preferably has a thickness in the axial direction.

With the mode described above, even when a user approaches the lighting device 1 and checks the light source portion, the light source of the LED light irradiation means 33 hardly enters user's eyes.

When the opening 311 has a circular shape with a radius of 0.1 cm or more and 0.3 cm or less, the thickness of the light transmitting placement portion 32 in the axial direction is preferably 0.3 cm or more, more preferably 0.4 cm or more, and still more preferably 0.45 cm or more.

With the mode described above, even when a user approaches the lighting device 1 and checks the light source portion, the light source of the LED light irradiation means 33 hardly enters user's eyes.

When the opening 311 has a circular shape with a radius of 0.1 cm or more and 0.3 cm or less, the thickness of the light transmitting placement portion 32 in the axial direction can be preferably 1 cm or less, more preferably 0.8 cm or less, and still more preferably 0.6 cm or less as a target.

In the lighting device 1 of the present embodiment, in the mode in which the light transmitting placement portion 32 is placed inside the housing, waterproof gasket 313 for a housing is provided so that the inside of the housing and the light transmitting placement portion 32 are liquid-tight.

With the mode described above, it is possible to provide the lighting device 1 that can be used even during rainfall, in which a candle cannot be used.

Here, examples of the waterproof gasket 313 for a housing preferably includes rubber waterproof gasket.

However, in the present invention, the type of a waterproof mechanism is not particularly limited as long as the inside of the housing and the light transmitting placement portion 32 can be liquid-tight.

(iii) LED Light Irradiation Means 33

In the lighting device 1 of the present embodiment, since the LED light irradiation means 33 is provided inside the housing 31, light can be emitted from a placement surface of the lighting equipment lens unit 2.

Figure 1:
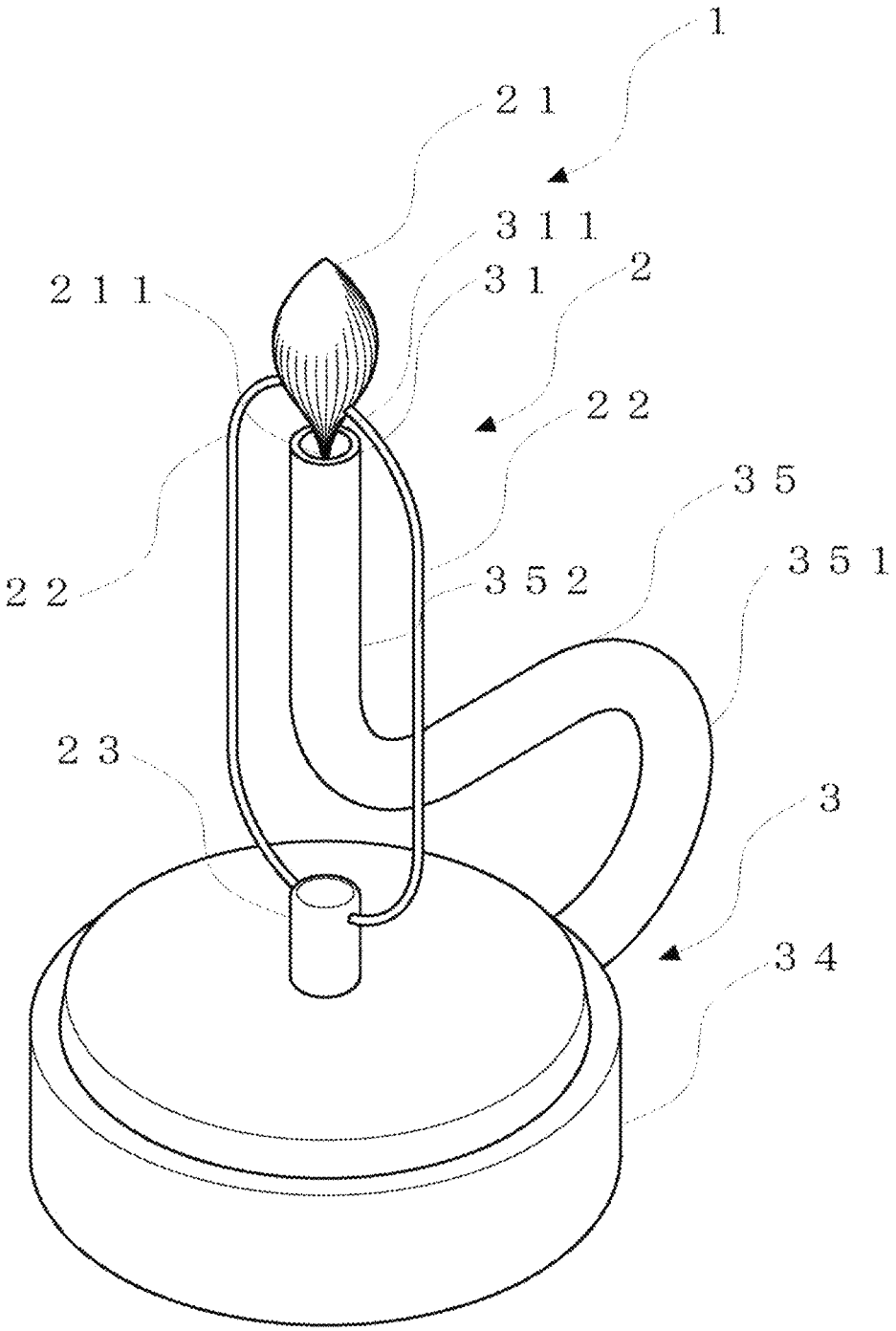
FIG. 1 illustrates a lighting device 1 of the present embodiment. Note that lines appearing on the surface of a lighting equipment lens 21 are shadow lines for showing a surface shape.
Figure 2:
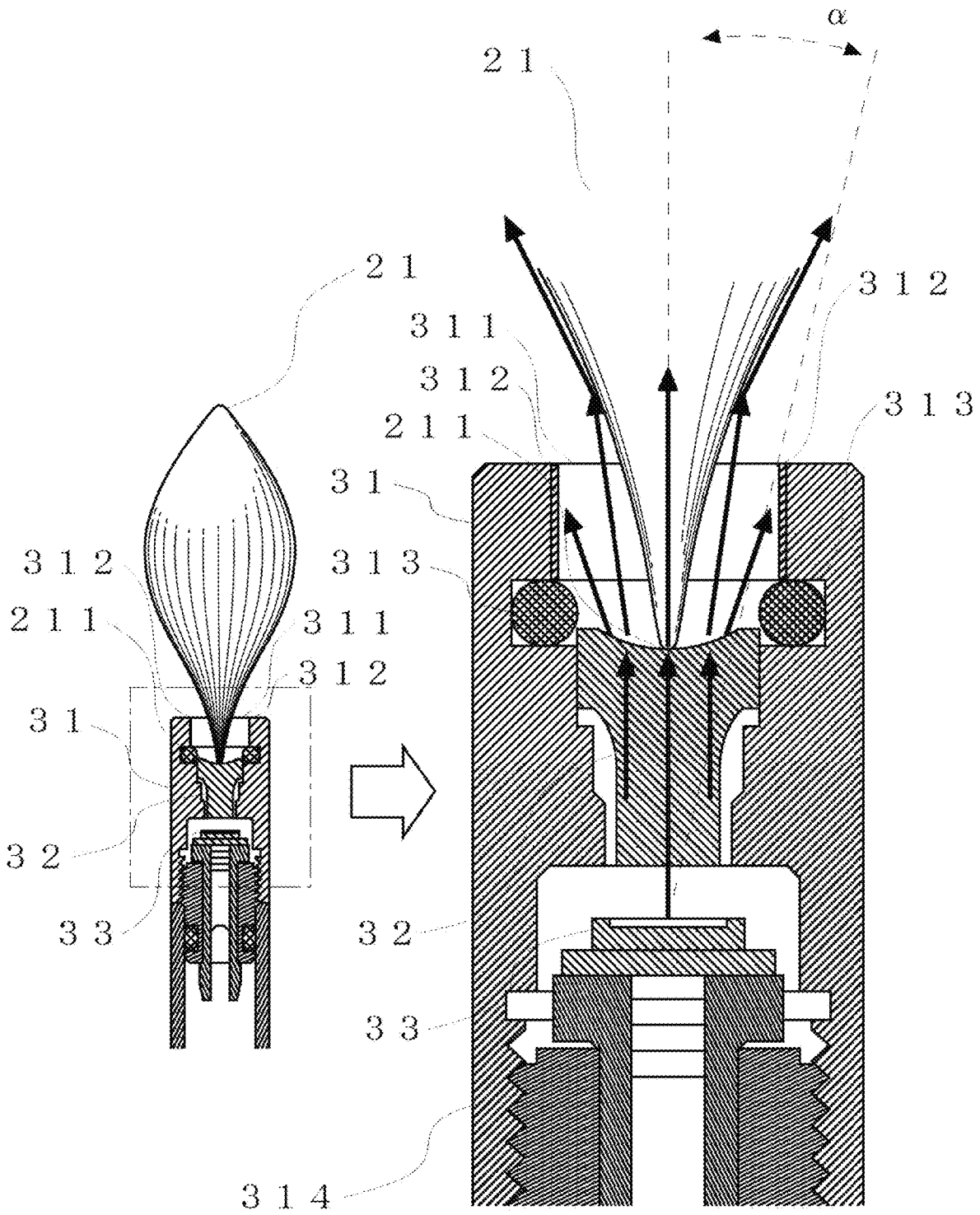
FIG. 2 is a schematic view illustrating an aspect in which a protruding portion of the lighting equipment lens 21 is placed on a light transmitting placement portion 32.

In the lighting device 1 of the present embodiment, the LED light irradiation means 33 is a light emitting diode (LED) (FIGS. 1 to 3).

Since the LED light irradiation means 33 is a light emitting diode (LED), it is possible to further suppress heat generation of the entire lighting device 1.

In addition, the LED light irradiation means 33 does not necessarily have to consist of a single light source, and may be a light source consisting of an aggregate of two or more light sources. Examples of the light source consisting of an aggregate of two or more light sources include a light source consisting of an aggregate of R (red) G (green) B (blue) light emitting diodes.

In addition, in the lighting device 1 of the present embodiment, the LED light irradiation means 33 is provided inside the housing 31 so as to be positioned below the light transmitting placement portion 32.

Since the LED light irradiation means 33 is provided inside the housing 31 so as to be positioned below the light transmitting placement portion 32, the LED light hardly enters the lighting equipment lens 21. Therefore, with the mode described above, it is possible to alleviate glare (dazzle) from the inside of the lighting equipment lens 21.

However, in the present invention, the placement of the LED light irradiation means 33 is not particularly limited as long as the irradiation of the light toward the opening 311 through the light transmitting placement portion 32 is allowed.

In the present invention, it is only necessary that the stand member 3 allows the irradiation of the light toward the opening 311 through the light transmitting placement portion 32.

In the lighting device 1 of the present embodiment, in the mode of being placed inside the housing, a waterproof screw 314 for a housing is provided so that the inside of the housing and the LED light irradiation means 33 are liquid-tight.

With the mode described above, it is possible to provide the lighting device 1 that can be used even during rainfall, in which a candle cannot be used.

Here, examples of the waterproof screw 314 for a housing preferably include a rubber coated screw body.

However, in the present invention, the type of the waterproof mechanism is not particularly limited as long as the inside of the housing and the LED light irradiation means 33 can be liquid-tight.

Hereinafter, other components in the lighting device 1 of the present embodiment will be described.

The lighting device 1 of the lighting device 1 of the present embodiment includes a connecting portion 35 connecting the base portion 34 and the housing 31 including the light transmitting placement portion 32.

Here, in the present invention, it is sufficient as long as the stand member 3 includes the light transmitting placement portion 32 for placing the protruding portion 211 of the lighting equipment lens unit 2 described above, and for example, the stand member 3 may have any mode of a stand member 3 (a hanging type lighting device 1) including a hanging implement, a stand member 3 (a clip type lighting device 1) including a clip portion for gripping a bar, and a stand member 3 (a handheld lighting device 1) including a handle portion to be gripped by a hand.

Hereinafter, particularly preferred modes of respective components when the lighting device 1 is a stationary lighting device will be described.

(iv) Base Portion 34

In the present specification, the base portion 34 refers to a member that allows the stand member 3 to stand on its own when placed on the ground.

The base portion 34 includes the base magnetic force generation mechanism 341 substantially coaxial with the protruding portion 211.

With the mode described above, the base magnetic force generation mechanism 341 included in the base portion 34 can affect the weight magnetic force generation mechanism 231 included in the weight portion 23.

Since the weight portion 23 receives the magnetic force, the lighting equipment lens unit 2 swings like a balancing toy more reliably for a longer time.

In the lighting device 1 of the present embodiment, the base magnetic force generation mechanism 341 provided in the base portion 34 is an electromagnet. By using the electromagnet, it is possible to provide the lighting device 1 with the lighting equipment lens unit 2 swinging like a balancing toy due to power from the outside (see an electric connection terminal 342).

In addition, by using the electromagnet as the base magnetic force generation mechanism 341, the degree of swinging of the lighting equipment lens 21 can be adjusted.

However, in the present invention, the base magnetic force generation mechanism 341 may be any of a ferrite magnet, a neodymium magnet, a samarium-cobalt magnet, an alnico magnet, and an electromagnet.

In the present invention, the number, weight, and mechanism of the base magnetic force generation mechanism 341 are not particularly limited.

For example, the base portion 34 may include the two or more base magnetic force generation mechanisms 341.

Here, in the lighting device 1 of the present embodiment, in the mode in which the base magnetic force generation mechanism 341 is placed inside the base portion 34, waterproof gasket 343 for a base and a waterproof sheet 344 for a base are provided in order to prevent water from entering the base magnetic force generation mechanism 341.

With the mode described above, it is possible to provide the lighting device 1 that can be used even during rainfall, in which a candle cannot be used.

Here, examples of the waterproof gasket 343 for a base preferably includes rubber waterproof gasket.

Furthermore, examples of the waterproof sheet 344 for a base preferably includes a rubber waterproof sheet.

However, in the present invention, the type of the waterproof mechanism is not particularly limited as long as water does not enter the base magnetic force generation mechanism 341.

(v) Connecting Portion 35

The connecting portion 35 is a member connecting the housing 31 including the light transmitting placement portion 32.

Here, the connecting portion 35 of the present embodiment includes a U-shaped curved portion 351 so that the connecting portion 35 is not positioned coaxially with the protruding portion 211 and horizontally in the vicinity of the weight portion 23.

Since the connecting portion 35 is curved so that the connecting portion 35 is not positioned coaxially with the protruding portion 211 and horizontally in the vicinity of the weight portion 23, the weight portion 23 and the connecting portion 35 are less likely to interfere with each other.

In addition, the connecting portion 35 of the present embodiment includes a bar portion 352 for supporting the housing 31 coaxially with the protruding portion 211.

Since the bar portion 352 for supporting the housing 31 is provided coaxially with the protruding portion 211, the arm portion 22 and the connecting portion 35 are less likely to interfere with each other.

With the mode described above, the lighting equipment lens unit 2 swinging like a balancing toy and the connecting portion 35 are less likely to interfere with each other.

However, in the present invention, the shape of the connecting portion 35 is not particularly limited as long as the connecting portion 35 connects the housing 31 and the base portion 34 and is configured not to interfere with a motion range of the lighting equipment lens unit 2.

The connecting portion 35 of the present embodiment is formed of a hollow member.

With the mode described above, it is possible to transmit power to the LED light irradiation means 33 provided in the housing 31 through an electric line (not illustrated) (see the electric connection terminal 342).

In addition, since the connecting portion is formed of a hollow member, it is possible to reduce the weight of the entire lighting device 1.

In the lighting device 1 of the present embodiment, the connecting portion 35 and the housing 31 are integrally formed.

However, in the present invention, the connecting portion 35 and the housing 31 may be configured as separate members.

Furthermore, in the lighting device 1 of the present embodiment, the waterproof gasket 343 for a base is provided so that a connected portion between the connecting portion 35 and the base portion 34 is liquid-tight.

With the mode described above, it is possible to provide the lighting device 1 that can be used even during rainfall, in which a candle cannot be used.

INDUSTRIAL APPLICABILITY

The present invention is applicable to a lighting device.

REFERENCE SIGNS LIST

1 lighting device
2 lighting equipment lens unit
21 lighting equipment lens
211 protruding portion
22 arm portion
23 weight portion
231 weight magnetic force generation mechanism
3 stand member
31 housing
311 opening
312 shade portion
313 waterproof gasket for a housing
314 waterproof screw for a housing
32 light transmitting placement portion
33 LED light irradiation means
34 base portion
341 base magnetic force generation mechanism
342 electric connection terminal
343 waterproof gasket for a base
344 waterproof sheet for a base
35 connecting portion
351 U-shaped curved portion
352 bar portion

The invention claimed is:

1. A lighting device provided with a lighting equipment lens, the lighting device comprising:

a lighting equipment lens unit; and a stand member on which the lighting equipment lens unit is placed, wherein the lighting equipment lens unit includes a lighting equipment lens in which a protruding portion capable of point-supporting the entire lighting equipment lens unit is formed, a center of gravity of the lighting equipment lens unit is located substantially coaxially with the protruding portion and below the protruding portion, the stand member includes:

a housing having an opening; and a light transmitting placement portion that is placed in the housing and allows placement of the protruding portion, the stand member allows irradiation of light toward the opening through the light transmitting placement portion, and a surface of the light transmitting placement portion on which the protruding portion is placed is formed into a concave shape; and the lighting equipment lens is made of a material having translucency; and an overall shape of the lighting equipment lens is a tapered shape at the lower end in the major axis direction of a prolate spheroid and a tapered shape at the upper end in the major axis direction of the prolate spheroid when the lighting equipment lens is placed such that the major axis direction of the prolate spheroid is oriented at the top and bottom; and the protruding portion is formed into a pointed shape; and the upper end side of the lighting equipment lens is formed into an obtuse shape in comparison with the protruding portion; and the lighting equipment lens unit further includes a weight portion and two arm portions connecting the lighting equipment lens and the weight portion; and the two arm portions are provided to hang downward from the lighting equipment lens.

2. The lighting device according to claim 1, wherein the surface of the light transmitting placement portion on which the protruding portion is placed is formed into a conically recessed shape, and an inclination angle of the surface is 5° or more and 30° or less.

3. The lighting device according to claim 1, wherein the stand member includes LED light irradiation means that is placed in the housing and allows irradiation of light toward the opening through the light transmitting placement portion.

4. The lighting device according to claim 1, the weight portion placed such that a center of gravity of the lighting equipment lens unit is located substantially coaxially with the protruding portion and below the protruding portion; and an overall shape of the arm portions is a ring shape.

5. The lighting device according to claim 4, wherein the lighting device is a stationary lighting device, the stand member includes:

a base portion that allows the stand member to stand on its own when placed on ground; and a connecting portion connecting the base portion and the housing including the light transmitting placement portion, and the connecting portion is curved so as not to interfere with the arm portion.

6. The lighting device according to claim 5, wherein the weight portion is located substantially coaxially with the protruding portion and below the protruding portion, the weight portion includes a magnetic force generation mechanism, and the base portion includes a magnetic force generation mechanism substantially coaxial with the protruding portion.

7. The lighting device according to claim 1, wherein a waterproof mechanism is provided so that the inside of the housing and the light transmitting placement portion are liquid-tight.

* * * * *